US007357289B2

(12) United States Patent
Schmetzer

(10) Patent No.: US 7,357,289 B2
(45) Date of Patent: Apr. 15, 2008

(54) WELDING HEAD FOR A STRAP BINDING MACHINE

(76) Inventor: Helmut Schmetzer, Almstr. 5, Bayreuth (DE) D-95448

( * ) Notice: Subject to any disclaimer, the term of this patent is extended or adjusted under 35 U.S.C. 154(b) by 154 days.

(21) Appl. No.: 10/844,811

(22) Filed: May 12, 2004

(65) Prior Publication Data

US 2005/0167469 A1 Aug. 4, 2005

(30) Foreign Application Priority Data

May 22, 2003 (DE) ..... 103 23 171

(51) Int. Cl.
*B23K 37/04* (2006.01)

(52) U.S. Cl. ..... 228/44.3; 228/49.4; 156/433

(58) Field of Classification Search ..... 228/44.3; 100/32; 219/158, 161
See application file for complete search history.

(56) References Cited

U.S. PATENT DOCUMENTS

| | | | | |
|---|---|---|---|---|
| 3,269,300 A | | 8/1966 | Billett et al. | |
| 3,847,071 A | | 11/1974 | Goodley | |
| 3,906,851 A | * | 9/1975 | Clark et al. | 100/4 |
| 4,020,756 A | * | 5/1977 | Weiss | 100/26 |
| 4,154,158 A | * | 5/1979 | Leslie et al. | 100/2 |
| 4,155,213 A | * | 5/1979 | Blanton et al. | 53/587 |
| 4,435,945 A | * | 3/1984 | Rohrig | 53/589 |
| 4,444,097 A | * | 4/1984 | Wehr et al. | 100/4 |
| 4,450,032 A | * | 5/1984 | Wehr | 156/353 |
| 4,575,994 A | * | 3/1986 | Takami | 53/582 |
| 4,661,185 A | * | 4/1987 | Kobiella | 156/212 |
| 4,850,179 A | | 7/1989 | Takami | 53/589 |
| 6,145,286 A | | 11/2000 | Huber | 53/589 |
| 6,403,917 B1 | | 6/2002 | Helldorfer | 219/121.63 |
| 2006/0242926 A1 | | 11/2006 | Schmetzer | |

FOREIGN PATENT DOCUMENTS

| | | | |
|---|---|---|---|
| DE | 38 19 868 | | 6/1988 |
| DE | 199 48 880 | | 10/1999 |
| DE | 102 32 580 | | 2/2004 |
| GB | 2205806 A | * | 12/1988 |
| JP | 57100878 A | * | 6/1982 |

OTHER PUBLICATIONS

U.S. Appl. No. 10/838,402, filed May 3, 2004, Schmetzer.

* cited by examiner

*Primary Examiner*—Kiley Stoner
(74) *Attorney, Agent, or Firm*—Jordan and Hamburg LLP

(57) ABSTRACT

Welding head for a strap binding machine includes a strap fixing device for fixing the overlapping strap ends that are to be welded to one another, a welding device for fusing the strap segments that are to be welded, and a pressing device for pressing the fused strap segments against a pressure part, whereby the strap fixing means are embodied as two separate, pivotably borne clamping jaws that are motion-coupled to the longitudinally movable pressing device such that they can be caused to engage and disengage with the binding strap depending on the movement of the pressing device.

28 Claims, 5 Drawing Sheets

WELDING HEAD FOR A STRAP BINDING MACHINE

BACKGROUND OF THE INVENTION

The invention relates to a welding head for a strap binding machine including strap fixing means for fixing the overlapping strap ends that are to be welded to one another, a welding device for fusing the strap segments that are to be welded, and a pressing device for pressing the fused strap segments against a pressure part.

Strap binding machines bind packaged goods, for instance a stack of catalogs or newspapers, with a strap, such as a stable plastic strap. In order to fix this strap in its taut state about the package, a welding head is provided that makes it possible to join the two overlapping strap ends of the binding strap, which is first fed via an appropriate insertion apparatus into a frame surrounding the package, the frame then being opened and the strap being securely tautened thereabout. This occurs in that the strap ends in the overlapping region are locally fused by means of a welding device and are pressed securely against a pressure part by means of a pressing device such that the joint results in the fused region. The manner in which a binding machine works is sufficiently well known, and it is not necessary to go into greater detail about this.

A welding head of the type cited in the foregoing is known for instance from DE 199 48 880 A1. It has two clamping jaws and a pressing device arranged therebetween. The two clamping jaws and the pressing device are longitudinally movable, for which purpose provided on the welding head housing are separate guide tracks, the cross-sections of which coincide with those of the clamping jaws. Guide tracks and clamping jaws must be worked very precisely for a precise longitudinal guide. Furthermore, in order for the clamping jaws to run smoothly and with low friction in the guide tracks, lateral flat lubrication pockets are formed in the clamping jaws and/or in the pressing device. It is evident that the longitudinal guides for the longitudinally moving parts are very complex in terms of design, which also has a negative effect on the total cost of the welding head. Another disadvantage is constantly assuring continuous lubrication in order to ensure that the longitudinally moving parts run smoothly. The open guide tracks furthermore tend to become soiled which is also disadvantageous.

SUMMARY OF THE INVENTION

The invention is based on the provision of suggesting a welding head that is improved both in terms of design and in terms of function.

For solving this problem, it is inventively provided in a welding head of the type described in the foregoing that the strap fixing means are embodied as two separate, pivotably borne clamping jaws that are motion-coupled to the longitudinally movable pressing device such that they can be caused to engage and disengage with the binding strap depending on the movement of the pressing device.

In the inventive welding head, each of the two clamping jaws that fix the strap ends is pivotably borne via a simple pivot bearing. Only the pressing device is borne longitudinally movable. Instead of three separate longitudinal guides, as in the past, in the inventive welding head only one is provided, while the two clamping jaws are pivotably held in one simple point of rotation, avoiding all of the disadvantages described in the foregoing. Furthermore, the clamping jaws are inventively preferably directly motion-coupled to the pressing device, i.e., their movement between end positions is controlled solely by the movement of the pressing device. The result is thus a mechanism that overall is simpler, less expensive, and more reliable and precise in function that eliminates all of the disadvantages described in the prior art.

With respect to a simple motion coupling, it is useful when the clamping jaws are arranged on both sides of the pressing device and coupled to the pressing device such that they pivot in opposing directions when the pressing device moves. The motion coupling can be such that they can be engaged with the binding strap with a time offset, which is useful because immediately after the binding strap has been inserted, the forward leading strap end must be fixed, which can be accomplished using the one clamping jaw. Then, after the guide frame has opened, the binding strap must be tautened securely about the package, which can occur for instance with a tautening system as is described in the subsequently published German patent application 102 32 580.04 using a lever tautener (reference is herewith made expressly thereto) with which the strap is retracted and tautened, whereupon first the strap must be fixed with the second clamping jaw.

For simple motion coupling, usefully provided on the clamping jaws or the pressing device are guide surfaces that control the movement and along which the pressing device or the clamping jaws slide. The guide surfaces are usefully embodied as inclined surfaces upon which the respective parts act, whereby the "time control" of the separate jaw movement can of course also be defined using the shape of these guide surfaces.

The clamping jaws can advantageously be caused to engage or disengage with the binding strap against a restoring force, i.e., during their movement, a restoring force automatically builds that is then reduced during the countermovement. The clamping jaws are usefully motion-coupled to one another via a spring, in particular a helical spring, whereby the spring exerts a restoring force on them in the position released from the binding strap. This means that the clamping jaws are automatically forced into their engagement position on the binding strap when the pressing device is moved appropriately, while they are pressed apart again, and the spring is placed under tension, during the countermovement. Naturally it is also conceivable to bear each clamping jaw against a restoring force via a separate spring or to design the bearing such that the restoring force builds up during a movement into the engaged position, in which case the motion coupling between the pressing device and the clamping jaws should be designed accordingly.

One particularly advantageous embodiment of the invention provides that the clamping segments of the clamping jaws that grip the binding strap are embodied on the upper jaw segments having the pressing device to the center and laterally offset to the pivot axis. What this accomplishes is that the clamping jaws, which for instance are adjacent to the strap only via the interior upper jaw edge, when the strap is retracted (relative to the first adjacent clamping jaws) or when the strap is taut (also for the second clamping jaws), are caused to wedge even more with the strap, either by the strap's active inherent tendency to shorten (when the strap is taut) due to the rigid tension, or by this strap movement, that is, the clamping effect is intensified even more. Thus, there is automatic self-clamping.

As described, the binding strap is inserted in a first step. For this, the binding strap is withdrawn from a strap storage unit, for instance, a strap storage unit as described in the aforementioned patent application 102 32 580.4, and is inserted into a strap guide frame encircling the packaged goods. The front end of the binding strap is re-captured in the welding head, whereupon the welding process can proceed. In order for the welding head to securely guide and also capture the binding strap, a strap guide element is provided that as a rule is likewise borne longitudinally displaceable in known welding heads. Thus, another longitudinal guide with the known disadvantages is described in the prior art. In order to create a remedy for this, as well, one particularly advantageous further development of the inventive thought provides that a pivotably borne strap guide element is provided that is directly or indirectly motion-coupled to the pressing device such that the strap guide element can be brought into and out of the strap guide path depending on the movement of the pressing device. The strap guide element is thus likewise pivotably borne. In accordance with the invention, the disadvantageous longitudinal guide is also omitted here. Furthermore, its movement also depends on that of the pressing device and both are correspondingly motion-coupled. The motion coupling can be such that the strap guide element is not moved out of the strap guide path until the strap ends have been fixed by the clamping jaws, that is, in this case as well it is only the motion coupling to the pressing unit that realizes the time control of the movement of the strap guide element. Depending on the design, indirect motion coupling, in which then the strap guide element is motion-coupled to the pressing device via an interposing element, is also conceivable, as is a direct motion coupling between the two parts. In the case of direct motion coupling, usefully provided at the pressing device or the strap guide element is a guide surface that controls the movement of the strap guide element, along which surface the strap guide element or the pressing device slides, depending on the design. Usefully provided on one of the two parts is a roller or drum or the like that slides along the guide surface.

In known welding heads in the prior art, as a rule, the welding device is also longitudinally displaceable in addition to the strap guide element, that is, this part is also disadvantageously designed in terms of its motion bearing. In order to also attain an improvement in this regard, in accordance with one particularly advantageous embodiment of the invention, it can be provided that the welding device is pivotably borne between a non-working position and a working position that fuses the strap segments, whereby the welding device is directly or indirectly motion-coupled to the pressing device such that movement occurs depending on the movement of the pressing device. Thus, in the inventive welding head, the disadvantageous longitudinal guide is eliminated in an advantageous manner in favor of a simple pivot bearing, whereby in this case as well the movement can be controlled using the pressing device due to a corresponding motion coupling thereto. Again, various coupling mechanisms can be provided. In the case of a direct motion coupling, a guide surface that controls the movement of the welding device is usefully provided at the pressing device or the welding device, along which guide surface the welding device or the pressing device slides, whereby this can also usefully occur using a roller or drum or the like. It is also possible to couple both the welding device and the previously described strap guide element directly to the pressing device but, by the same token, indirect coupling is also possible for both.

In one useful embodiment of a motion-coupling provides for coupling the welding device indirectly to the pressing device, the welding device is releasably coupled to the strap guide element such that it is moved out of the strap guide path into the working position when the strap guide element moves. In this embodiment of the invention, the welding device is directly coupled to the strap guide element, which itself is usefully directly coupled to the pressing device. Due to the releasable coupling of the welding device to the strap guide element, its movement is at least partially determined (until the coupling is released) by the movement of the strap guide element.

For this purpose, the strap guide element and the welding device are usefully pivotable in the same direction about a common point of rotation during the joint movement. Thus, only one axis of rotation is provided, whereby the design is such that the strap guide element is brought out of the strap guide path and the welding device is simultaneously moved into the strap guide path.

The motion coupling of the strap guide element and the welding device is usefully automatically released upon attaining the working position of the welding device, which in accordance with one advantageous embodiment of the invention is attained using a magnetic coupling of the two parts. For this, for instance, provided on one or on both parts is/are corresponding magnetic clamps that adhere to one another during the coupling, are separated for the release, and are re-connected to one another in the framework of a subsequent welding step. For producing the restoring force, it is useful to provide a spring that pulls or presses the welding device and/or the strap guide element into the non-working position.

As described in the foregoing, pressure is exerted against a pressure part for joining the fused strap ends. In order subsequently to be able to remove the bound packaged goods from the binding apparatus, it is necessary that the binding strap be released from the pressure part in the region of the weld, for which purpose the pressure part is also borne longitudinally movable in known binding machines and thus has all of the described disadvantages. In order to remedy this, as well, one very useful further development provides that the pressure part is also borne pivotable and is motion-coupled to the pressing device such that, depending on the movement of the pressing device, the pressure part is movable between a working position, in which the strap ends can be pressed thereagainst by the pressing device, and a non-working position, in which the welded binding strap is released. Usefully also provided here on the pressing device or pressure part is a guide surface, along which the pressure part or the pressing device slides for motion control, if needed, using a roller or drum or the like. Thus, if the pressure part is also pivotably borne, there is ideally only one single longitudinal guide in the inventive welding head, namely, that of the pressing device, while all of the other parts are movably borne via simple pivot bearings. Advantageously, the only element that determines movement is the pressing device, to which all of the pivotable parts are directly or indirectly motion-coupled. Thus, the result is a simply constructed welding head that is entirely novel in terms of its design and that eliminates the disadvantages of the prior art.

As described, the motion coupling of the pressure part to the pressing device also occurs via a suitable guide surface, that is, both are directly motion-coupled to one another. In order to be able to initiate the outward pivoting movement of the pressure head in a simple manner, one advantageous embodiment of the invention provides for moving the pressing device further in the pressing direction after the fused strap ends are pressed together, during which movement the pressure part, which until then had been counterborne on the guide surface, is released and pivots away. The pressing device is thus overpressed somewhat relative to the actual pressing position, which leads to the pressure part being released from its counterbearing and being able to pivot away. Usefully provided on the pressing device is an overhead pressing segment that engages the strap ends and that is joined via at least one spring element to the base body of the pressing device, which spring element is compressed during the further movement of the pressing device.

In addition to the welding head, the invention furthermore relates to a strap binding machine including a welding head of the type described.

BRIEF DESCRIPTION OF THE DRAWINGS

Additional advantages, features, and details of the invention result from the exemplary embodiment described in the following and from the drawings, wherein.

Each of the figures illustrates a front elevation and the associated side elevation, whereby for the sake of clarity many parts are only illustrated in one or the other representation.

DESCRIPTION OF THE PREFERRED EMBODIMENTS

Figure 1A:
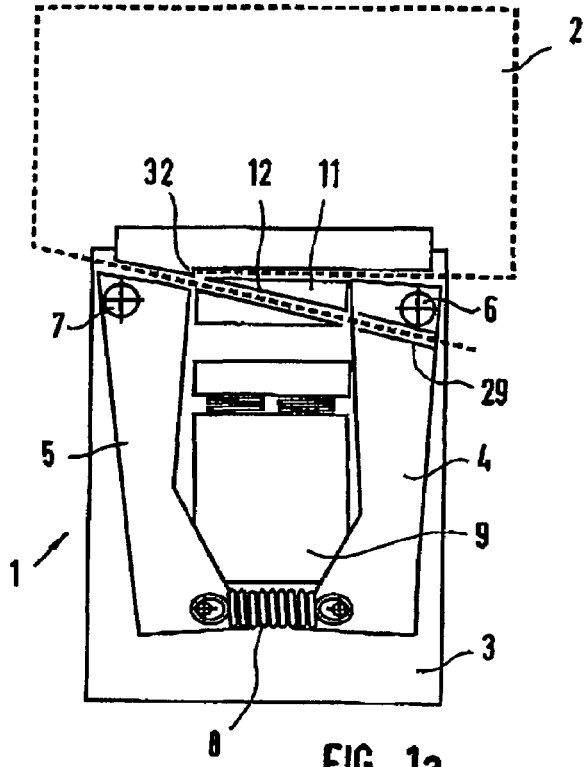
FIGS. 1*a*-8*b* illustrate the inventive welding head in various positions assumed during a welding process, whereby each of the figures labeled with "a" show a front elevation and each of the figures labeled with "b" show a side elevation of the same position.
Figure 1B:
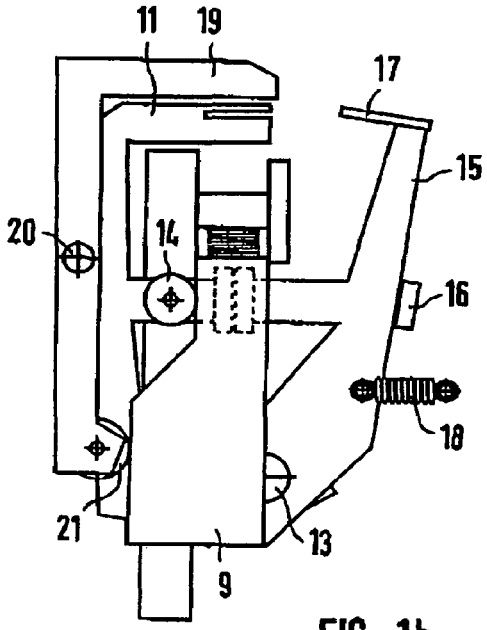

FIGS. 1*a* and 1*b* illustrate the inventive welding head 1 in its initial position after the binding strap 2 has been inserted and has been guided in a frame (not shown in greater detail) encircling a package (also not shown in greater detail). The inventive welding head 1 has a base plate 3 on which a right clamping jaw 4 and a left clamping jaw 5 are borne pivotable about pivot bearing 6 and 7, respectively. They are coupled to one another via a spring 8 at their lower ends. Disposed between these two clamping jaws 4, 5 is the pressing device 9, which is longitudinally movable via a longitudinal guide (not shown in greater detail) and with which the two clamping jaws 4, 5 are directly motion-coupled. For this purpose, provided on each side of the pressing device (see for instance FIG. 5*a*) are two guide surfaces 10 that cooperate with suitable segments provided on each of the clamping jaws 4, 5. In the position illustrated in FIG. 1*a*, the pressing device 9 is in the lowered position in which it acts on the clamping jaws 4, 5 and forces them outward into the position not acting on the binding strap 2. The spring 8 is under tension.

Furthermore illustrated is a strap guide element 11 that has an inclined guide channel 12 into which the strap in FIG. 1*a* is inserted coming from the right. The strap guide element 11 is pivot-borne about the pivot axis 13 (see also for instance FIG. 5*b*). It can pivot between the working position illustrated in FIGS. 1*a* and 1*b* and the outwardly pivoted position illustrated for instance in FIGS. 5*a* and 5*b*, that is, the position not disposed in the strap guide path. For this purpose, the strap guide path 11 is likewise directly motion-coupled to the pressing device 9, for which reason provided on the strap guide element 11 is a roller 14 that acts on the back side of the pressing device 9. The base plate 3 is perforated so that the individual parts can cooperate with one another. At this point it should be noted that the figures illustrate the basic design principle and of course appropriate additional housing or holding parts are provided that form the axes of rotation, etc.

Furthermore provided is a welding device 15 (see for instance FIGS. 1*b* and 5*b*) that is movable between a non-working position (FIG. 1*b*), in which it is counterborne on an appropriate counterbearing 16, and a working position (FIG. 5*b*), in which its welding tongue 17, which fuses the strap ends, is disposed in the strap guide path. The welding device 15, together with the strap guide element 11, is pivotably borne about the common pivot bearing 13, and can be moved into the working position against the restoring force of a spring 18.

Figure 5A:
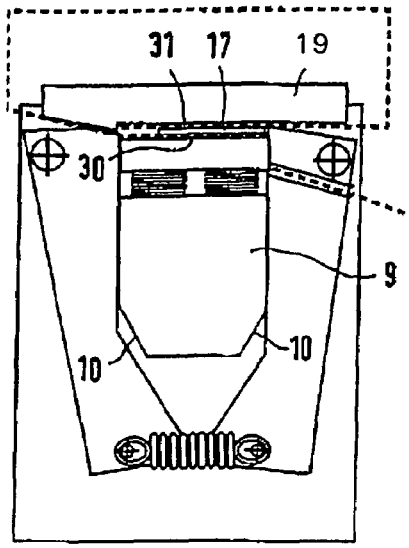
Figure 5B:
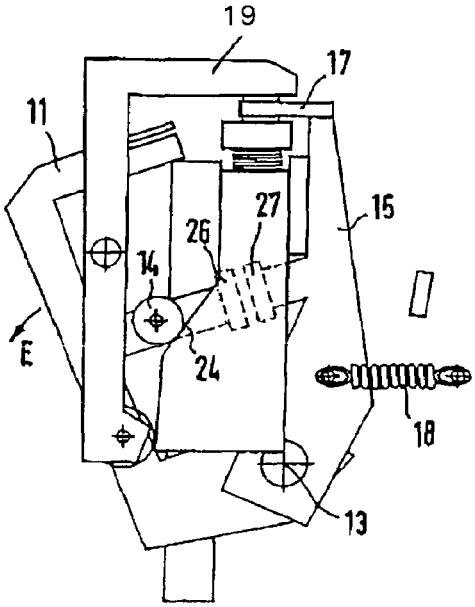

Finally, a pressure plate 19 is provided against which the pressing device 9 presses the strap ends (see for instance FIG. 5*b*). The pressure plate 19 is also borne pivotable about a pivot bearing 20. It is likewise directly motion-coupled to the back side of the pressing device 9 via a roller 21 and counterborne there.

Overall, then, it is only the pressing device 9 that is longitudinally borne, while the two clamping jaws 4, 5, the strap guide element 11, the welding device 15, and the pressure plate 19 are all movably received in simple pivot bearings.

Starting with FIGS. 1*a*, 1*b*, the working process of the welding head 1 will now be described as follows.

As has already been stated, FIGS. 1*a* and 1*b* illustrate the situation immediately after the binding strap 2 has been inserted. Starting from this position, the pressing device 9 is moved somewhat upward into the position illustrated in FIGS. 2*a*, 2*b*. What this leads to is that initially the right clamping jaw 4 is released after the guide surface 10 allocated to it, embodied as an inclined surface, is drawn upward during the movement, and the clamping jaw 4 can slide therealong. Due to the restoring force of the spring 8, it is moved in the direction of the arrow A about the pivot bearing 6, until the clamping segment 22, here the upper left and inwardly directed edge, acts on the binding strap 2. As can be seen, the clamping segment 22 is to the left and inward of the pivot bearing 6. What this leads to is that the clamping jaw 4, during the retraction movement of the binding strap 2 (opposing the insertion direction) into the strap storage unit (which, along with the other parts of a known binding apparatus, is not shown here) to tauten the strap about the packaged good to be bound. In order to fix the binding strap 2, at this point the clamping jaw 4 is already engaged. Due to the position of the clamping segment 22, it clamps even stronger with the strap which, after the frame (not shown here) is opened, is retracted against the insertion direction. The binding strap is thus fixed on one side. Starting from the position in FIGS. 3*a*, 3*b*, the pressing device 9 is now pushed further upward until the guide surface 10 of the pressing device 9, that is allocated to the left clamping jaw 5, releases it such that it pivots due to the restoring force of the spring 8 and clamps the binding strap 2 (arrow B). The clamping segment 23 is also disposed to the center right at the upper portion of the clamping jaw 5.

Figure 2A:
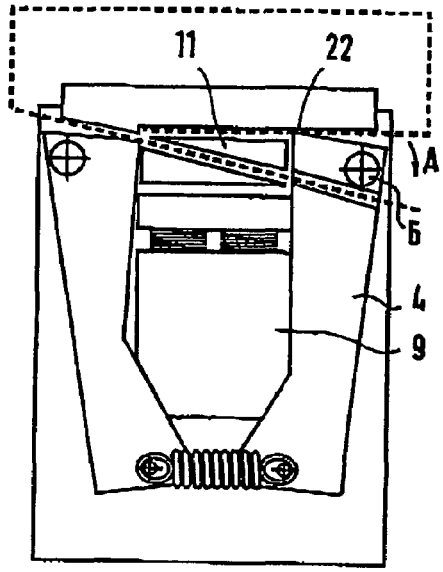
Figure 2B:
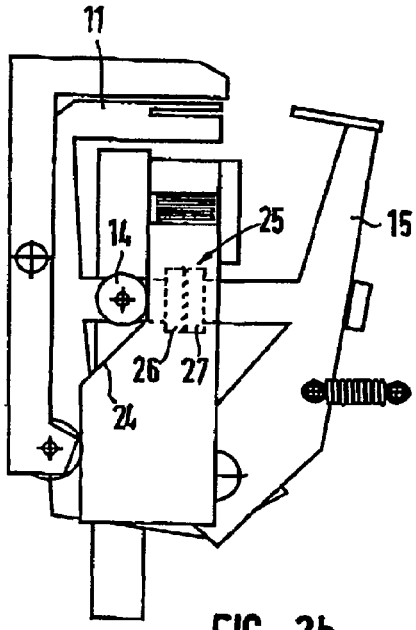
Figure 3A:
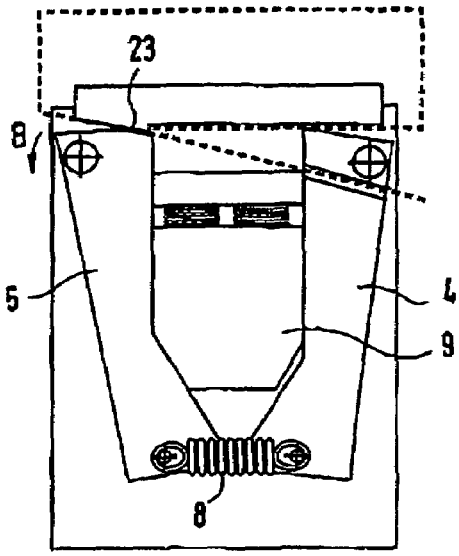
Figure 3B:
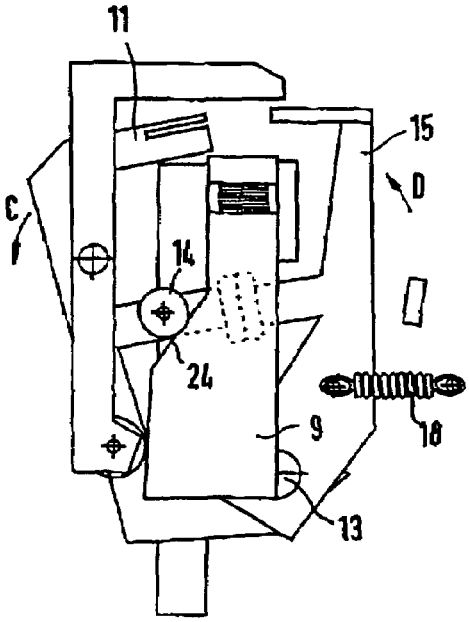

During this movement, the strap guide element 11 simultaneously pivots out of the strap guide path in which it is still situated in the position in accordance with FIGS. 2*a*, 2*b* (see FIG. 3*b*). What this realizes is that during the movement of the pressing device 9 into the position in accordance with FIGS. 3*a*, 3*b*, the roller 14 runs on the inclined guide surface 24 on the back side of the pressing device 9 and in doing so causes the strap guide element to pivot to the left about the pivot bearing 13 out of the strap guide path (arrow C).

Simultaneous to this outward pivoting movement by the strap guide element 11, the welding device 15 moves in the direction of the strap guide path (see FIG. 3*b*). For this purpose, the strap guide element 11 and the welding device 15 are directly motion-coupled to one another, for which purpose a magnetic coupling 25 is provided that in the illustrated example includes two magnets 26, 27, of which one is arranged on the strap guide element 11 and one is arranged on the welding device 15. Thus, if the welding device 15 moves, the welding device 15 automatically moves about the common pivot bearing 13 (arrow D) while the coupling exists. The spring 18 is placed under tension. In every case, the binding strap stretched about the packaged good is fixed at two points via the clamping jaws 4, 5 after reaching the position in accordance with FIGS. 3*a*, 3*b*.

Figure 4A:
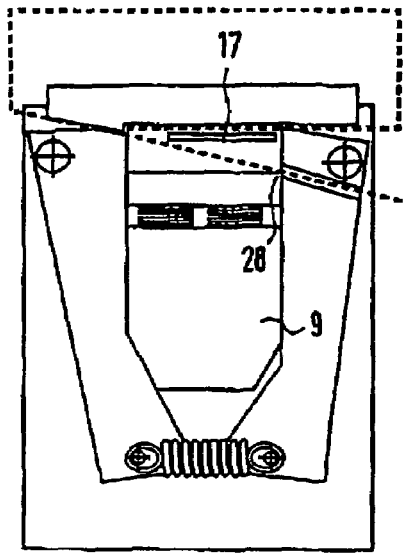
Figure 4B:
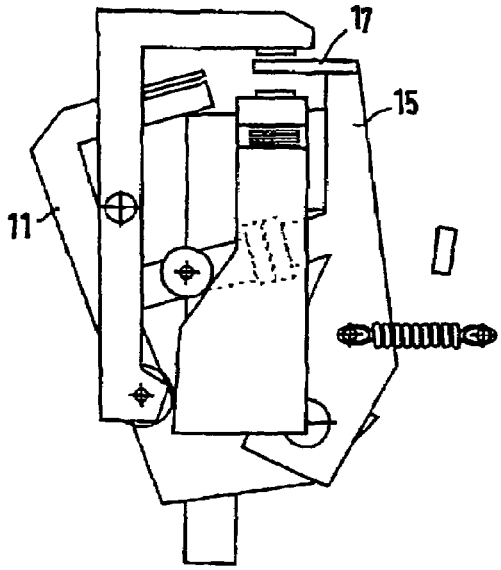

Now, starting with the position in accordance with FIGS. 3*a*, 3*b*, if the pressing device 9 moves further upward, the roller 14 continues to run on the guide surface 24, so that the strap guide element 11 is moved even further to the left out of the strap guide path and the welding device 15 is moved even further to the left into the strap guide path. FIGS. 4*a*, 4*b* illustrate the welding device 15 with the welding tongue 17 disposed in the strap guide path.

Now, starting with the position in accordance with FIGS. 4*a*, 4*b*, if the pressing device 9 moves even further upward, a knife edge 28 cuts the binding strap 2 in the region of the right clamping jaw 4, which has a corresponding through-hole 29 for the strap to be inserted as the figures illustrate. When the pressing device 9 is lifted even further, the rear strap end 30 overlaps the front strap end 31, which is still in the original position directly below the pressure part 19, which has a corresponding catch edge 32. Disposed between these two ends is the hot welding tongue 17. The two strap ends are fused in this position.

Furthermore, during the movement into the position in accordance with FIGS. 5*a*, 5*b*, the magnetic coupling 25 and thus the motion-coupling of the welding device 15 to the strap guide element 11 is released. This occurs because the roller 14 runs even further on the guide surface 24, that is, pivots to the left (arrow E), while the welding device 15 is already fixed in its working position. Because the strap guide element 11 is forced to move to the left via the guide surface 24, the two magnets 26, 27 are forced apart and thus the welding device 15 is released.

Figure 6A:
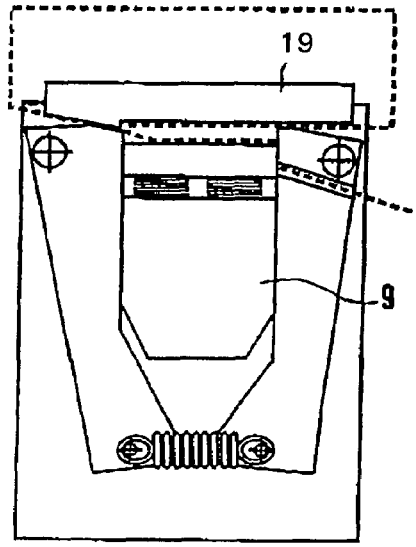
Figure 6B:
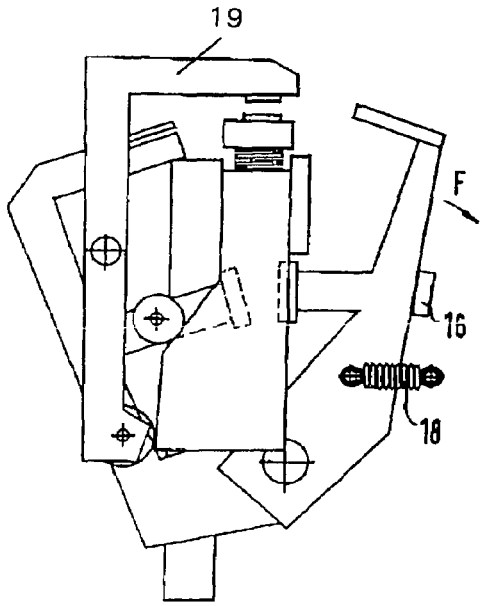

Subsequently (FIGS. 6*a*, 6*b*), the pressing device 9 is retracted a short distance so that the weld joint unloads somewhat with respect to the pressure plate 19 and thus the clamped welding tongue 17 is also released. What this leads to is that the welding device 15 is completely released and is pulled back into the non-working position by the spring 18, as illustrated in FIG. 6*b* (arrow F).

In the next step (FIGS. 7*a*, 7*b*), the pressing device 9 now again travels upward so that the strap ends 30, 31 are pressed against the pressure plate 19 and join securely to one another as a result of the fusing. The two strap ends 30, 31 are pressed together for a certain period of time until the weld joint has cooled sufficiently.

Figure 7A:
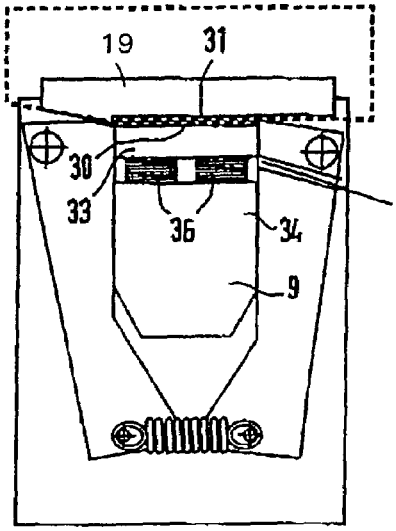
Figure 8A:
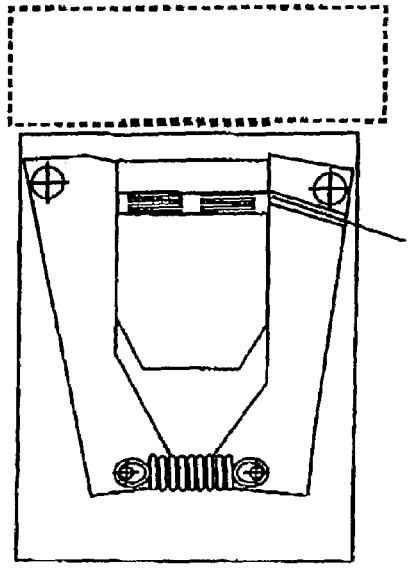
Figure 7B:
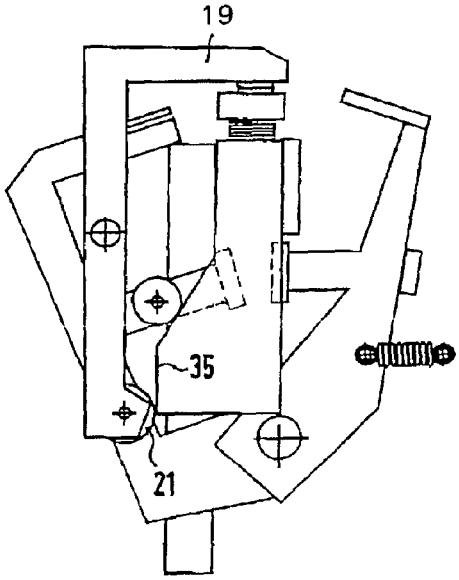
Figure 8B:
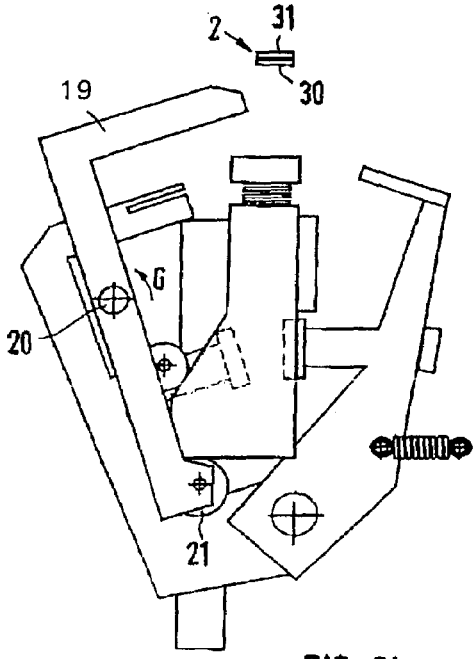

In the position illustrated in FIGS. 7*a*, 7*b*, the pressure plate 19 is disposed between the welded binding strap and the packaged good; that is, the packaged good is adjacent to the pressure plate 19. It is now necessary to release the welded binding strap so that the bound package can be removed. This occurs in that the pressing device 9 is moved somewhat further upward, whereby two springs 36, via which the pressing segment 33 of the pressing device, which pressing segment acts on the lower strap end 30 and is joined to the base body 34 of the pressing device 9, are compressed. The base body 34 moves somewhat upward, which leads to the situation in which when there has been a transition into the position illustrated in FIGS. 8*a*, 8*b*, the roller 21, via which the pressure plate 19 had thus far been counterborne on the guide surface 35 of the pressing device 9, is released. Because of the pressure that the pressing device 9 exerts against the pressure plate 19, upon reaching the release position, it automatically pivots about the pivot bearing 20 (arrow G) out of the strap guide path into the release position illustrated in FIG. 8*b*, in which the welded binding strap 2 is released.

Then the pressing device 9 moves back downward which leads to a situation in which initially the pressure plate 19 pivots back into the starting position, so the roller 21 runs back up the guide surface 35. As the pressing device lowers, the roller 14 of the strap guide element 11 also runs back up the guide surface 24, which leads to a situation in which the strap guide element 11 is moved back into the position in the strap guide path illustrated in FIG. 1*b*. This can be realized using a spring (not shown in greater detail) that pulls the strap guide element 11 back into the position, which spring is placed under tension while the strap guide element pivots out of the strap guide path. Once in the position in the strap guide path, the two magnets 26, 27 act upon one another again so that the releasable motion-coupling between strap guide element 11 and welding head 1 is re-created. While the pressing device 9 moves downward, furthermore, the two clamping jaws 4, 5, now adjacent to the guide surfaces 10, are pressed apart from one another. Thereupon they pivot about the pivot bearing 6, 7 into the position in accordance with FIG. 1*a*. Now another welding process can begin, starting with inserting the binding strap.

It should be noted that FIGS. 1*a*-8*b* merely illustrate the principles for the functioning of the inventive welding head. For reasons of clarity housing parts and the like on which each of the elements is guided or borne are not illustrated. This also applies with respect to the motion control of the pressing device 9, which must be raised and lowered cyclically as described. This can occur for instance via a suitable curve control, or even via a suitable lifting means, e.g., a cylinder, or even via an electromotor.

Figure 10:
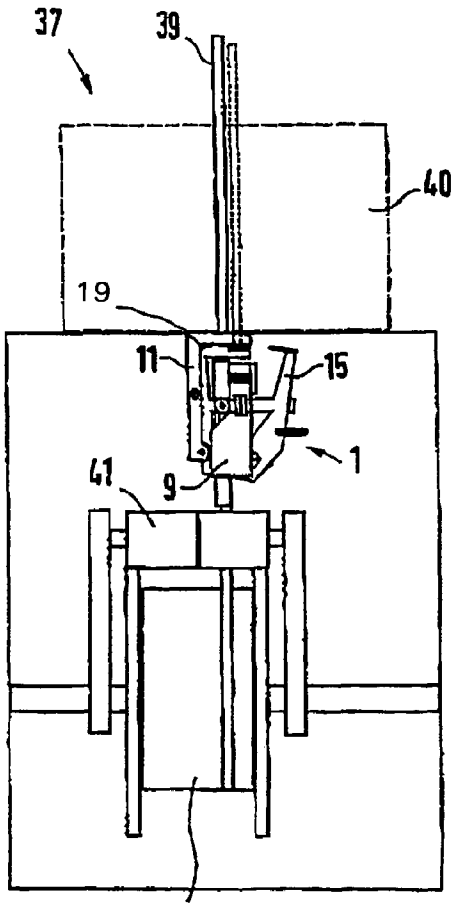
Figure 9:
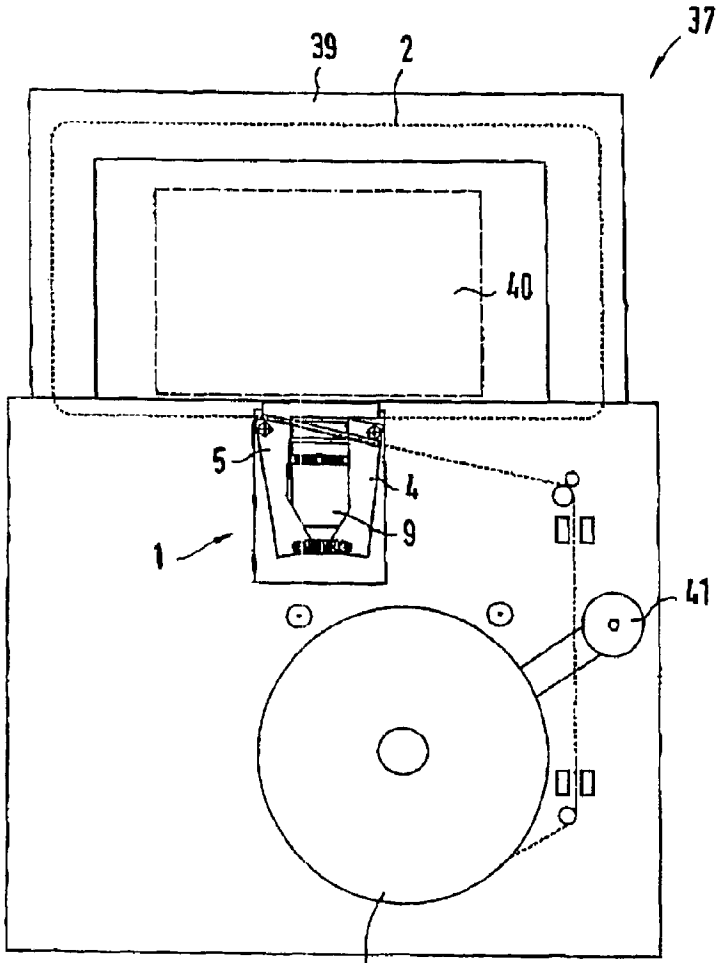
FIG. 9 illustrates the principle of a binding machine with the welding head, shown in a front elevation; and, FIG. 10 illustrates a side elevation of the binding machine in FIG. 9.

FIGS. 9 and 10 illustrate a binding machine with the described welding head. The binding machine 37 has a strap reel 38 from which a strap 2 to be inserted is drawn off. This is inserted into a frame 39 that encircles the package 40 by the welding head 1. After the strap is fixed using the clamping jaws 4, the frame 39 is opened so that the strap 2 can be tautened by means of the lever tautener 41, which pivots to the left and carries the strap. The tautening mechanism is known from German patent application 120 32 580.4. Then the described welding process begins.

The invention claimed is:

1. A welding head for a strapping machine, comprising:

a support;

a pair of separate clamping jaws being pivotably mounted to said support, said clamping jaws being operable for fixing overlapping strap segments of a binding strap to be welded by engaging respective positions along said binding strap, pivoting movement of said clamping jaws selectively bringing said clamping jaws into and out of engagement with said binding strap;

a welding device for partially melting portions of said overlapping strap segments;

a pressure member being disposed on a first side of said overlapping strap segments;

a pressing device mounted to said support for longitudinal movement therealong, said pressing device pressing said overlapping strap segments against said pressure member when longitudinally moved to engage a second side of said overlapping strap segments; and guide surfaces provided on said clamping jaws or said pressing device, a remaining one of said clamping jaws and said pressing device including cooperative segments which are engagebly contactable with said guide surfaces to responsively couple the longitudinal movement of said pressing device with a corresponding pivoting movement of each of said clamping jaws relative to said pressing device, direct engaged contact of the cooperative segments and the guide surfaces thereby converting the longitudinal movement of the pressing device into the pivoting movement of the clamping jaws such that said clamping jaws are brought into and out of engagement with said binding strap at said respective positions in direct response to the corresponding longitudinal movement of said pressing device.

2. A welding head in accordance with claim 1, wherein said clamping jaws are arranged on both sides of said pressing device and coupled to said pressing device such that they pivot in opposing directions when said pressing device moves according to said longitudinal movement.

3. A welding head in accordance with claim 1, wherein said pressing device and said clamping jaws are motion-coupled such that they can be engaged with said binding strap with a time offset.

4. A welding head in accordance with claim 1, said clamping jaws or said pressing device slidably engaging said guide surfaces provided on a remaining one of said clamping jaws or said pressing device.

5. A welding head in accordance with claim 1, wherein said clamping jaws can be caused to engage or disengage with said binding strap against a restoring force.

6. A welding head in accordance with claim 5, wherein said clamping jaws are motion-coupled to one another via a spring that exerts a restoring force on them in the position released from said binding strap.

7. A welding head in accordance with claim 1, wherein the clamping segments of said clamping jaws that engage said binding strap are embodied on upper jaw segments having the pressing device to a center and laterally offset to a pivot axis.

8. A welding head in accordance with claim 1, wherein a pivotably borne strap guide element is provided that is directly or indirectly motion-coupled to said pressing device such that the strap guide element can brought into and out or the strap guide path depending on the movement of said pressing device.

9. A welding head in accordance with claim 8, wherein said strap guide element is motion-coupled to said pressing device such that the strap guide element is not moved out of the strap guide path until the strap ends have been fixed by said clamping jaws.

10. A welding head in accordance with claim 9, wherein when there is direct motion coupling to said pressing device or said strap guide element, a strap guide surface is provided that controls the movement of said strap guide element, said strap guide element or said pressing device being slidable along said strap guide surface.

11. A welding head in accordance with claim 10, wherein provided on said strap guide element or said pressing device is a roller or drum that slides along said strap guide surface.

12. A welding head in accordance with claim 1, wherein:

said welding device can be pivoted between a non-working position and a working position that fuses said strap segments; and said welding device is directly or indirectly motion-coupled to said pressing device such that the movement of the welding device depends on the movement of said pressing device.

13. A welding head in accordance with claim 12, wherein when there is direct motion-coupling to said pressing device or to said welding device, a guide surface is provided that controls the movement of said welding device, along which guide surface said welding device or said pressing device slides.

14. A welding head in accordance with claim 13, wherein on said welding device or said pressing device is a roller or drum that slides along said guide surface.

15. A welding head in accordance with claim 8, wherein said welding device is releasably coupled to said strap guide element such that it is moved out of the strap guide path into a working position when said strap guide element moves.

16. A welding head in accordance with claim 15, wherein said welding device is directly coupled to said strap guide element and said strap guide element is directly coupled to said pressing device.

17. A welding head in accordance with claim 15, wherein said strap guide element and said welding device pivot in the same direction about a common point of rotation during joint movement.

18. A welding device in accordance with claim 15, wherein the motion coupling of said strap guide element and said welding device is automatically released upon attaining the working position of said welding device.

19. A welding head in accordance with claim 15, further comprising a magnetic coupling for coupling said strap guide element to said welding device.

20. A welding head in accordance with claim 8, wherein at least one of said welding device or said strap guide element can be moved into a working position against a restoring force.

21. A welding head in accordance with claim 20, further comprising a spring that pulls or presses said welding device or said strap guide element into a non-working position for producing said restoring force.

22. A welding head in accordance with claim 1, wherein said pressure part is pivotably borne and is motion-coupled to said pressing device such that, depending on the movement of said pressing device, the pressure part is movable between a working position, in which said strap ends can be pressed thereagainst by said pressing device, and a non-working position in which said welded binding strap is released.

23. A welding head in accordance with claim 22, wherein said pressing device or said pressure part is a guide surface, along which said pressure part or said pressing device slides for motion control.

24. A welding head in accordance with claim 23, wherein a roller or a drum is provided on said pressure part or said pressing device that slides along said guide surface of said pressure part or said pressing device.

25. A welding head in accordance with claim 22, wherein after pressing said fused strap ends together, said pressing device can be moved further in the pressing direction, during which movement said pressure part, that until then was counterborne on said guide surface, is released and pivots away.

26. A welding head in accordance with claim 25, where:

said pressing device is an overhead pressing segment that is joined via at least one spring element to said base body of said pressing device; and said spring element is compressed during the further movement of said pressing device.

27. The welding head of claim 1, wherein:

said two clamping jaws are capable of pivoting in a first plane; and said welding device and said member arc capable of pivoting in a second plane, said second plane being essentially perpendicular to said first plane.

28. A strap binding machine, comprising:

a welding head, including a support;

a pair of separate clamping jaws being pivotably mounted to said support, said clamping jaws being operable for fixing overlapping strap segments of a binding strap to be welded by engaging respective positions along said binding strap, pivoting movement of said clamping jaws selectively bringing said clamping jaws into and out of engagement with said binding strap;

a welding device for fusing the overlapping strap segments that are to be welded;

a pressing device for pressing said overlapping strap segments against a pressure part; and guide surfaces provided on said clamping jaws or said pressing device, a remaining one of said clamping jaws and said pressing device including cooperative segments which are engagebly contactable with said guide surfaces to responsively couple the longitudinal movement of said pressing device with a corresponding pivoting movement of each of said clamping jaws, direct engaged contact or the cooperative segments and the guide surfaces thereby converting the longitudinal movement of the pressing device into the pivoting movement of the clamping jaws such that said clamping jaws can be caused to engage and disengage with said binding strap at said respective positions in direct response to the corresponding longitudinal movement of said pressing device, the clamping jaws pivoting relative to the pressing device when being caused to engage and disengage with said binding strap by the longitudinal movement of said pressing device.

* * * * *